United States Patent [19]

Orii

[11] Patent Number: 4,889,062

[45] Date of Patent: Dec. 26, 1989

[54] SEWING MACHINE WITH MEANS FOR FEEDING A WORKPIECE IN TWO DIRECTIONS

[75] Inventor: Akira Orii, Tokyo, Japan

[73] Assignee: Janome Sewing Machine Industry Co., Ltd., Kyobashi, Japan

[21] Appl. No.: 268,111

[22] Filed: Nov. 7, 1988

[51] Int. Cl.[4] ..... D05B 27/14

[52] U.S. Cl. ..... 112/318; 112/260

[58] Field of Search ..... 112/78, 80, 73, 322, 112/318, 308, 309, 260, 314, 323, 324, 102; 226/152, 154, 155; 271/225, 250, 251

[56] References Cited

U.S. PATENT DOCUMENTS

| | | | |
|---|---|---|---|
| 3,727,567 | 4/1973 | Beazley | 112/309 X |
| 4,019,447 | 4/1977 | Blessing et al. | 112/308 X |
| 4,303,027 | 12/1981 | Vemura et al. | 112/318 X |
| 4,467,737 | 8/1984 | Breck, Jr. | 112/309 X |
| 4,602,583 | 7/1986 | Hanyu | 112/445 X |

*Primary Examiner*—Andrew M. Falik
*Attorney, Agent, or Firm*—Klein & Vibber

[57] ABSTRACT

A sewing machine capable of producing embroidery stitches on a workpiece which in general require the workpiece to be shifted relative to a needle in a lateral direction as well as a longitudinal direction. The sewing machine has first and second vertical extending presser bars provided at their lower ends with press rollers. The presser bars are spring-biased downwardly so that the press rollers exert downwardly directing pressure onto the workpiece. First and second feed rollers are arranged within a workpiece supporting table of the sewing machine, in opposition to the press rollers respectively. The first feed rollers are rotated by a first drive motor to feed the workpiece in the lateral direction, whereas the second feed rollers are rotated by a first drive motor to feed the workpiece in the longitudinal direction, thereby feeding the workpiece in any direction in a desired amount. The workpiece feeding amounts in both directions are separately controlled in response to stitch control data stored for the selected stitch pattern. Sequential control for each stitch will produce desired embroidery stitches.

7 Claims, 4 Drawing Sheets

SEWING MACHINE WITH MEANS FOR FEEDING A WORKPIECE IN TWO DIRECTIONS

FIELD OF THE INVENTION

This invention relates to a sewing machine and more particularly to a sewing machine capable of producing embroidery stitches as well as stitching together workpieces superposed one over another.

BACKGROUND OF THE INVENTION

The conventional electronic zigzag sewing machines for home use has a laterally swingable needle, and a workpiece can be fed in forward and backward direction by means of a feed dog mounted on a workpiece supporting table of the sewing machine. The needle amplitude and the workpiece feeding amount will be controlled responsive to stitch control data of the selected stitch pattern which is read out from a memory in each stitch. A loop taker mounted within the workpiece supporting table is rotated in synchronism with vertical reciprocation of the needle to form a stitch composed of upper and lower threads as in a well-known manner.

The needle amplitude will, however, be limited to the order of 7 mm in actual machine design since the needle must enter a thread loop formed around the loop taker. The workpiece feeding amount in each stitch will also be limited due to efficiency of the feed device. Consequently, the conventional sewing machine will not be suitable for producing embroidery stitches.

Another type sewing machine especially adapted to produce embroidery stitches has also been provided, which has an embroidery frame for accomodating and supporting a workpiece and means for shifting the embroidery frame in any direction. This sewing machine will, in turn, not be applicable to normal stitching operation. This sewing machine will require a powerful torque force and thus an expensive motor for shifting the embroidery frame.

SUMMARY OF THE INVENTION

It is therefore an object of the invention to provide a sewing machine capable of producing embroidery stitches while not impairing functions inherent to the sewing machine.

According to an aspect of the invention there is provided a sewing machine comprising first press means adapted to come into contact with a workpiece to be stitched to exert a downwardly directing pressure onto the workpiece; second press means adapted to come into contact with the workpiece to exert a downwardly directing pressure onto the workpiece; first drive means cooperating with said first press means being in contact with the workpiece for feeding the workpiece in a first direction; second drive means cooperating with said second press means being in contact with the workpiece for feeding the workpiece in a second direction substantially perpendicular to the first direction; and control means for independently controlling said first and second drive means, thereby feeding the workpiece in said first and second directions in independent and sequential manner.

BRIEF DESCRIPTION OF THE ACCOMPANYING DRAWINGS

The above and other objects of the invention as well as characteristic features thereof will be fully understood from the following detailed description when read in conjunction with the accompanying drawings in which.

DESCRIPTION OF A PREFERRED EMBODIMENT

Figure 1:
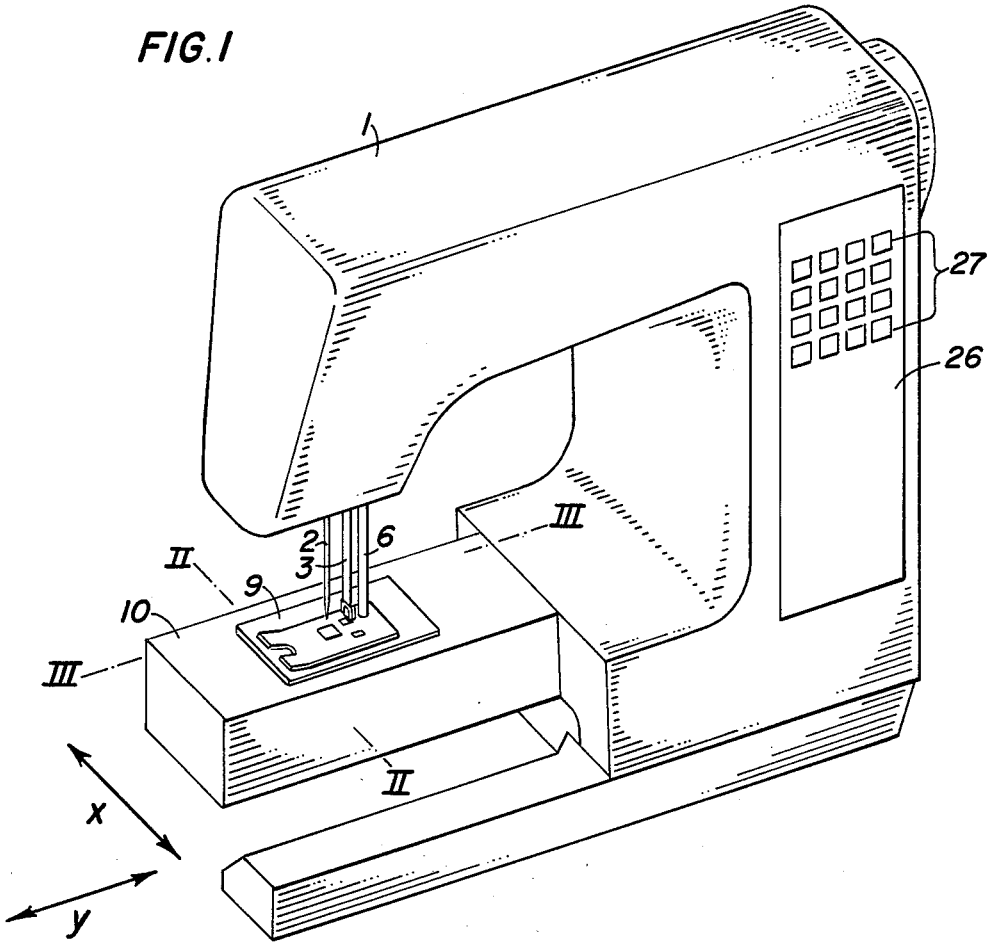
FIG. 1 is a schematic perspective view showing an electronic sewing machine embodying the invention.
Figure 2:
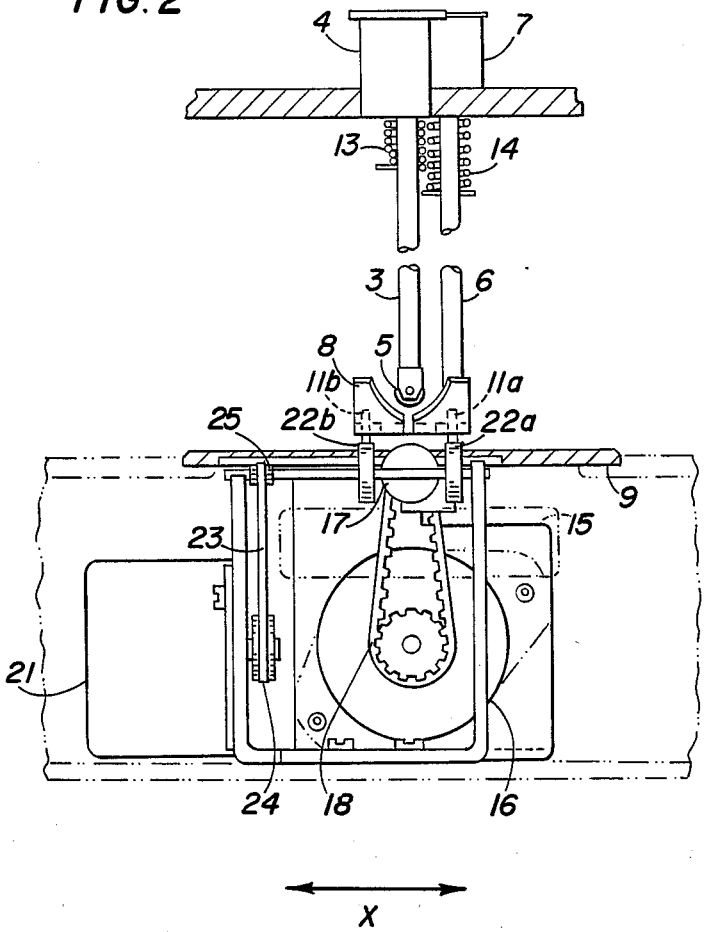
FIG. 2 is a partial sectional view taken along the line II—II in FIG. 1.
Figure 3:
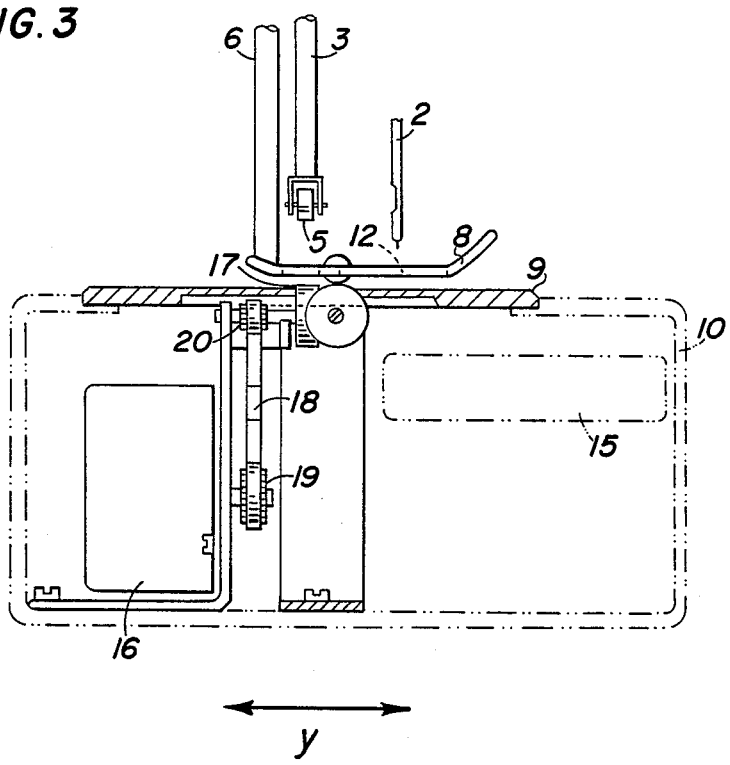
FIG. 3 is a partial sectional view taken along the line III—III in FIG. 1.

With reference to FIGS. 1 to 3, an electronic sewing machine embodying the invention includes a housing or arm 1 in which an upper drive shaft (not shown) is rotatably mounted. A needle 2 is supported near the projecting end of the arm 1 and allowed to reciprocate up and down in synchronism with rotation of the upper drive shaft. A first presser bar 3 extends down from the projecting end of the arm 1 and is moveable in up/down direction by means of a first solenoid 4 mounted within the arm 1. At the lower end of the first presser bar 3 there is provided a freely rotatable press roller 5. A second presser bar 6 also extends down from the projecting end of the arm 1 in parallel with the first presser bar 3 and is moveable in up/down direction by means of a second solenoid 7 mounted within the arm 1. To the lower end of the second presser bar 6 there is connected a presser foot 8 for exerting a downwardly directing pressure onto a workpiece (not shown) placed on a needle plate 9 attached to a workpiece supporting table 10 of the machine housing. A pair of press rollers **11*a*, 11*b* are rotatably supported by the presser foot 8. The presser foot 8 is provided with an aperture 12 for allowing the needle 2 to penetrate the workpiece therethrough. Springs 13 and 14 are provided for normally biasing the first and second press bars 3 and 6**, respectively, to descend.

In a hollow space of the workpiece supporting table 10 is rotatably supported a horizontal loop taker 15 which is rotated via a lower drive shaft (not shown) in synchronism with rotation of the upper drive shaft so that a thread loop hook portion (not shown) of the loop taker 15 is cooperated with the needle 2 to form a stitch composed of upper and lower threads as well known in the conventional stitching operation. In this embodiment, the workpiece can be shifted along the needle plate 9 in a direction extending in width of the machine (which will be hereinunder called "X direction") as well as in another direction extending in length of the machine, normal to the X direction (which will be hereinunder called "Y direction"). For shifting the workpiece in X direction, a first motor 16 mounted within the bed 10 is driven to rotate a feed roller 17 located in opposition to the press roller 5, via a drive mechanism which comprises in this embodiment a belt 18 and pulleys 19 and 20. For shifting the workpiece in Y direction, a second motor 21 also mounted within the bed 10 is driven to rotate feed rollers **22*a* and 22*b* located in opposition to the press rollers 11*a* and 11*b*, respectively. The drive mechanism for transmitting rotation of the shaft of the motor 21 to the feed rollers 22*a* and 22*b* also comprises in this embodiment a belt 23 and pulleys 24 and 25**.

The machine housing 1 has a keyboard panel 26 on which are arranged a number of operating keys or switch buttons (not shown) including stitch pattern selecting keys 27. Operation of the stitch pattern select key 27 will select a desired stitch pattern and thus read out stitch control data from a memory unit mounted in the housing so that the sewing machine becomes ready for producing the selected stitch pattern on the workpiece.

The illustrated sewing machine will be operated as follows. The sewing machine is made operative when power is supplied thereto. A desired one of the stitch patterns is selected by operation of the corresponding stitch pattern select key 27 provided on the keyboard panel 26, whereby the stitch control data of the selected stitch pattern is sequentially read out from the memory unit for determining each needle dropping point. Thus, the amounts of feeding the workpiece in X and Y directions will be determined and the resulting data are temporarily stored. Similarly, the data for controlling the solenoids 4 and/or 17 for actuating the presser bars 3 and/or 6 are temporarily stored. The workpiece feeding amounts determining data and the solenoid controlling data both for shifting the workpiece in X and Y directions will determine a first needle position relative to the workpiece to produce a first stitch of the selected stitch pattern. Further stitches are sequentially produced in like manner.

Figure 4:
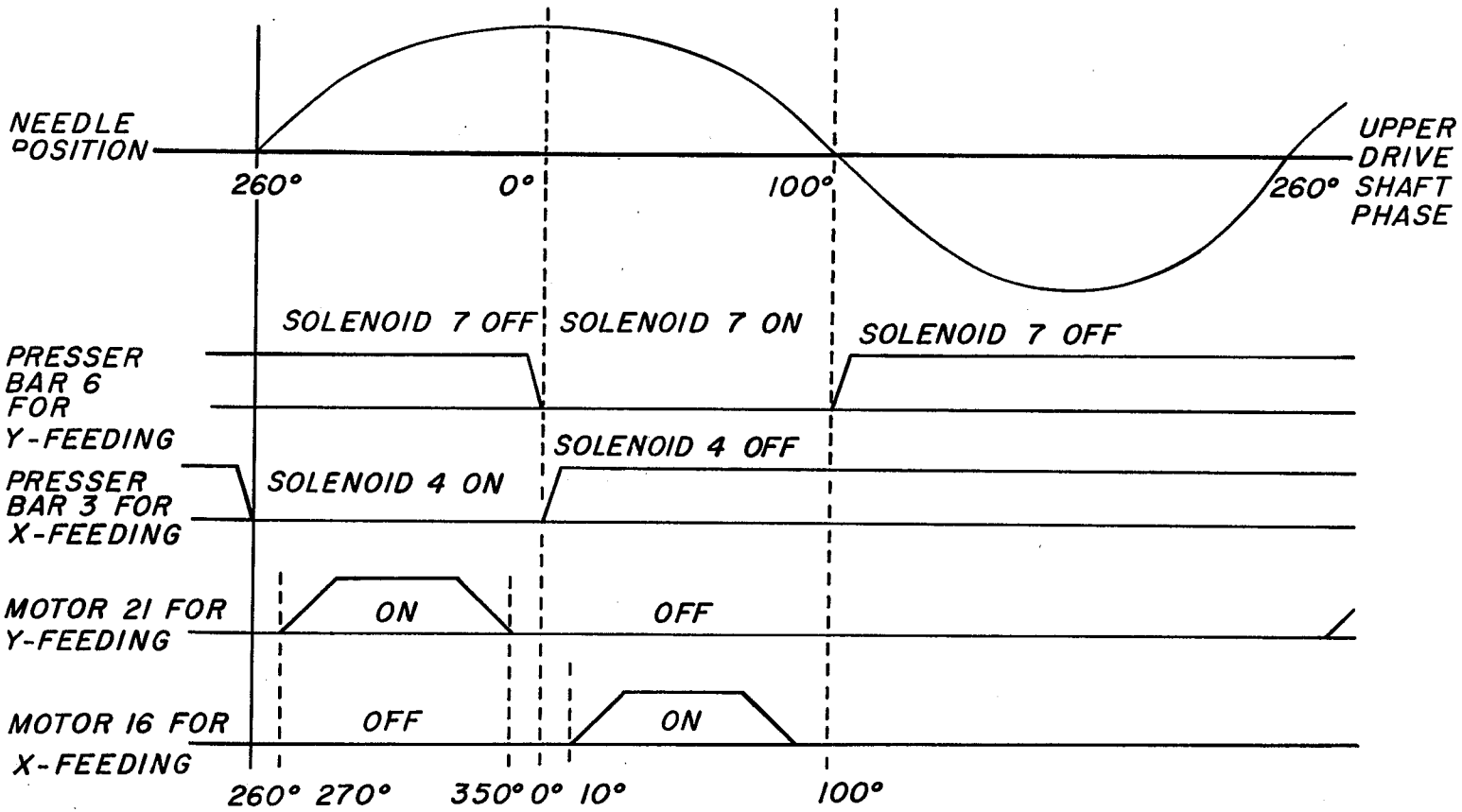
FIG. 4 is a timing chart showing an exemplified operation of the sewing machine when producing embroidery stitches.

FIG. 4 is a timing chart illustrating operation of the sewing machine by way of example. The needle 12 is reciprocated in synchronism with rotation of the upper shaft. The upper drive shaft phase is detected at least each 10° interval. The needle 12 comes to the upper dead point at 0° phase and then start descending so that from 100° to 260° phase its pointed end penetrates the workpiece. In this example shown in FIG. 4, the stitch is produced while shifting the workpiece both in X and Y directions. First, a controller (not shown) is operated to start a sewing machine motor (not shown) to rotate the upper drive shaft. At a timing of the upper drive shaft phase of 260°, at which time the needle has just left from the workpiece to start ascending, the solenoid 7 is OFF in response to the solenoid controlling data (for Y direction shifting) so that the presser bar 6 descends by the biasing force of the spring 14. Thus, the workpiece is interposed under pressure between the press rollers 11*a* and 11*b* and the feed rollers 22*a* and 22*b*. Then at 270° phase, the motor 21 is driven under control in response to the workpiece feeding amount determining data (for Y direction shifting) so that the workpiece is shifted over a predetermined distance or pitch in Y direction. The workpiece shifting operation in Y direction has been completed at 350° phase. Then, at 0° phase the solenoid 7 is turned ON to attract the presser bar 6 upwardly, thereby releasing the press rollers 11*a* and 11*b* from contact with the workpiece. At the same time, the solenoid 4 is turned OFF in response to the solenoid controlling data (for X direction shifting) so that the presser bar 3 descends by the biasing force of the spring 13. Thus, the workpiece is interposed under pressure between the press roller 5 and the feed roller 17. Then at 10° phase, the motor 16 is driven under control in response to the workpiece feeding amount determining data (for X direction shifting) so that the workpiece is shifted over a predetermined distance or pitch in X direction. The workpiece is therefore shifted in X direction during 10° to 90° phase. Consequently, the workpiece has been shifted in X and Y directions in predetermined amounts respectively, which will be determined in response to the stitch control data of the selected stitch pattern, before producing each stitch. While the needle is penetrating the workpiece during 100° to 260° phase, the solenoid controlling data for X and Y directions control the sewing machine such that the solenoids 4 and 7 remain OFF so that the press rollers 5, 11*a* and 11*b* are all in contact with the workpiece under pressure. Thus, the needle 2 penetrates the workpiece which lies between the press rollers and the non-driven feed rollers 17, 22*a* and 22*b*, and the workpiece is therefore prevented from erroneously shifting in X and Y directions, whereby the stitch is produced on the workpiece. During 100° to 260° phase, the workpiece feeding amount determining data and the solenoid controlling data for producing the next stitch will be processed based on the stitch control data therefor. The above described sequential operation is repeated each stitch to produce the selected stitch pattern.

According to this invention, the workpiece is fed in a substantial amount in each stitch by employing roller means. Since the workpiece is fed in one direction and then in another direction normal to the said one direction, the workpiece can be fed in any direction and in any desired amount. Thus, the embroidery stitches can easily be produced with beautiful appearance. The sewing machine according to this invention is also applicable to the normal stitching operation without disturbing any characteristic inherent to the sewing machine.

while this invention has been described in conjunction with a specific embodiment thereof, it is to be understood that many variations and modifications may be made without departing the scope and spirit as defined in the appended claims. For example, while the illustrated embodiment employs the solenoids for actuating the presser bars, it may be replaced with linear motors capable of varying downwardly directing pressure exerted onto the workpiece in synchronism with the drive means such that the downwardly directed pressure is adjusted according to the speed of feeding the workpiece. This will save energy or power of the motor used for driving the feed rollers. More particularly, as the motor accelerates the torque increases by virtue of inertia so that the downwardly directing pressure may be decreased accordingly. When the motor is running at a constant high speed, in turn, the presser bar must exert a sufficient degree of the downwardly directing pressure onto the workpiece to thereby prevent slippery motion of the workpiece. Use of the linear motor or the like capable of controlling the downwardly directing pressure exerted by the presser bars onto the workpiece will minimize a loss of power of the driving motors without decreasing efficiency of the workpiece feeding operation. Further, the needle may be a laterally swingable one, providing improved applicability of the stitch patterns to be produced with the sewing machine. In the illustrated embodiment the presser foot 8 is secured to the lower end of the presser bar 6, various presser foots may be selectively attached to the presser bar 6 with a fastening means. The press and/or feed rollers may have uneven periphery for increasing friction with respect to the workpiece, thereby feeding the workpiece without slipperiness.

What is claimed is:

1. A sewing machine comprising:

first press means adapted to come into contact with a workpiece to be stitched to exert a downwardly directing pressure onto the workpiece;

second press means adapted to come into contact with the workpiece to exert a downwardly directing pressure onto the workpiece;

first drive means cooperating with said first press means and adapted to come into contact with the workpiece opposite a point said first press means contacts the workpiece for feeding the workpiece in a first direction;

second drive means cooperating with said second press means and adapted to come into contact with the workpiece opposite a point said second press means contacts the workpiece for feeding the workpiece in a second direction substantially perpendicular to the first direction; and control means for independently controlling said first and second drive means, thereby feeding the workpiece in said first and second directions in an independent and sequential manner.

2. The sewing machine according to claim 1 which further comprises memory means for storing stitch control data for a plurality of stitch patterns and wherein said control means is operated in stitches of said stitch patterns in response to said stitch control data of a selected one of the stitch patterns.

3. The sewing machine according to claim 1 wherein said control means is operated to feed the workpiece in said first and second directions while a vertically reciprocating needle is not in contact with the workpiece.

4. The sewing machine according to claim 3 wherein said first and second press means are kept in contact under pressure with the workpiece while the needle penetrates the workpiece.

5. The sewing machine according to claim 1 wherein each of said first and second press means comprises a vertically extending rod-like member, first roller means rotatably attached to the lower end of said rod-like member and means for vertically displacing said rod like member to selectively release and achieve contact between said first roller means and the workpiece.

6. The sewing machine according to claim 5 wherein each of said first and second drive means comprises a drive motor and second roller means rotated with said drive motor and arranged in opposition to said first roller means of said press means.

7. The sewing machine according to claim 6 which further comprises means for varying the downwardly directing pressure exerted by said first and second press means onto the workpiece in synchronism with operation of said first and second drive means.

* * * * *